United States Patent [19]

Shibata

[11] Patent Number: 4,679,277

[45] Date of Patent: Jul. 14, 1987

[54] FULL LENGTH INTERLOCKING HINGE FOR A FOLDING DOOR

[75] Inventor: Yoji Shibata, Tokyo, Japan

[73] Assignee: Shin Nihon Koku Seibi Co., Ltd., Tokyo, Japan

[21] Appl. No.: 806,862

[22] Filed: Dec. 9, 1985

[30] Foreign Application Priority Data

Dec. 10, 1984 [JP] Japan ..... 59-187157[U]

[51] Int. Cl.[4] ..... E05D 7/00

[52] U.S. Cl. ..... 16/354; 16/382

[58] Field of Search ..... 16/252, 354, 382; 412/43

[56] References Cited

U.S. PATENT DOCUMENTS

| | | | |
|---|---|---|---|
| 2,583,350 | 1/1952 | Witzgall | 16/382 X |
| 2,804,229 | 8/1957 | Bergh et al. | 16/382 X |
| 3,402,422 | 9/1968 | Baer | 16/354 X |

FOREIGN PATENT DOCUMENTS

| | | | |
|---|---|---|---|
| 2457413 | 6/1975 | Fed. Rep. of Germany | 16/354 |
| 1542245 | 3/1979 | United Kingdom | 16/354 |
| 1596274 | 8/1981 | United Kingdom | 16/354 |

OTHER PUBLICATIONS

Military Standard MS20001 (2 pages).

Weber Aircraft Illustrated Parts Catalogue (25-40-06), pp. 76-80.

*Primary Examiner*—Fred Silverberg

*Attorney, Agent, or Firm*—Armstrong, Nikaido, Marmelstein & Kubovcik

[57] ABSTRACT

A hinge is disclosed for folding doors appropriate for use in lavatories on airplanes where the highest degree of airtightness is required. It consists of a basic frame hollow in shape, and a pair of moving frames. The moving frames have longitudinal flanges to support the door panel and connect with the opening slit of the basic frame by way of the supporting pieces. Longitudinal cogs are provided on the end of the supporting piece, such that they engage one another to rotate and enable smooth operation of the hinge. Each cog has a semicircular interior surface which cooperates with supporting shafts of the basic frame for rotation therearound.

3 Claims, 5 Drawing Figures

FULL LENGTH INTERLOCKING HINGE FOR A FOLDING DOOR

BACKGROUND OF THE INVENTION

The type of hinge presented here is one to be used for lavatory doors in airplanes; however, it is also applicable to doors for telephone booths, unit baths and many other items.

The space required by a folding door operation is generally smaller than for an ordinary door.

Usually, double actuated piano hinges are used for folding doors.

These hinges, however, do not completely block either light or odors, consequently, when they are used for doors of airplane lavatories, these shortcomings may inconvenience passengers sitting nearby. In order to avoid this problem, a rubber-coated cloth or a similar material is used to cover the hinge areas. Nevertheless, this solution has drawbacks, because black stains appear on the cover by being rubbed during operation. On the other hand, the double hinge system has drawbacks because of the excess noise and does not always operate smoothly due to unwanted vibration.

This present invention is intended to solve the above problems, by offering a higher degree of airtightness and a greater smoothness of operation.

SUMMARY OF THE INVENTION

The hinge presented here consists of a basic frame 2 and a pair ov moving frames 3. The basic frame 2 has axial edges terminating in two parallel supporting shafts 6 facing one another through inward bends 5. Frames 3 in the external face of the joint 9 extend to form two cogged semicircles 11 engaged with one another. The interior surfaces of the cogged semicircles form cavities 12 which engage the outer surface of supporting shafts 6 on both sides of the basic frame 2. In other words, the instant invention provides for the simultaneous use of frames 2 and 3 by supporting shafts 6 engaged with the cavities 12 and the cogged semicircles 11 cooperatively interacting with one another.

According to this structure, a pair of moving frames placed in a door enables the supporting shafts of the basic frame to act as axes, and, at the same time, allows opening and closing through the functioning of the cogs.

DESCRIPTION OF PREFERRED EMBODIMENTS

Figure 1:
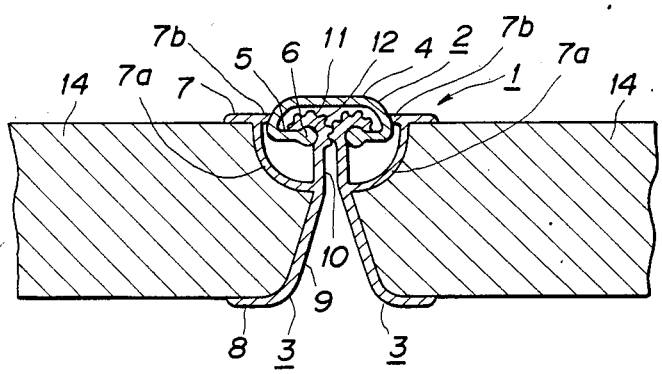
FIG. 1 shows a cross-sectional view of a hinge of the instant invention in the closed position.
Figure 2:
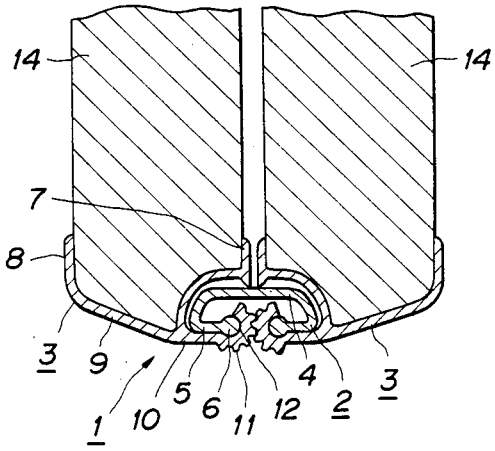
FIG. 2 shows a cross-sectional view of the hinge of FIG. 1, in the open position.

The explanations regarding the figures are as follows:

As shown in FIGS. 1 and 2, number 1 corresponds to the hinge and this hinge 1 is composed of the basic frame 2 and a pair of moving frames 3.

The basic frame 2 is made of an aluminum alloy or other materials, with a long vertical shape. In its external face, a joint 4 found having inward bends 5 bent toward one another and, having supporting shafts 6 on the longitudinal edges thereof.

The pair of moving frames 3 is also made of an aluminum alloy or other materials and are the same length as the basic frame. Opposing longitudinal flanges 7 and 8 which face one another are parts of joint 9 from which supporting pieces 10 extend, and, at their ends, semicircular cogs are formed having their interior cavities 12 pivotally engaging the above mentioned supporting shafts 6. Longitudinal flange 7 has a curved part **7*a* and an edge 7*b* which contacts and slides along the outside surface of joint 4**.

In this system, as explained above, the basic frame 2 and the moving frames 3 are joined by supporting shafts 6 and cavities 12 as well as by the engaging pair of cogs 11.

Figure 3:
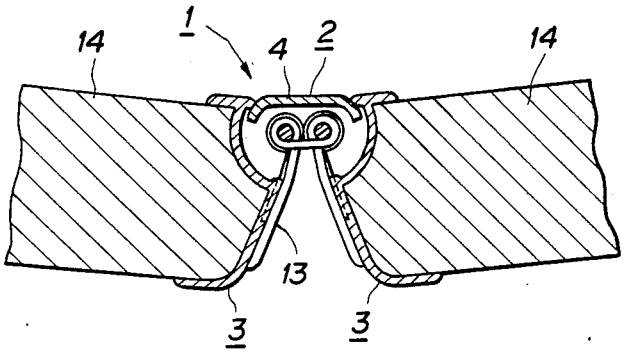
FIG. 3 shows a cross-sectional view of the hinge with a spring.

Moreover, as it is shown in FIG. 3, a spring could be placed in either the upper or lower part of the frames 3 in order to bias frames 3 closer together (so that the door will have a tendency to close). A hinge 13 includes the spring.

Figure 4:
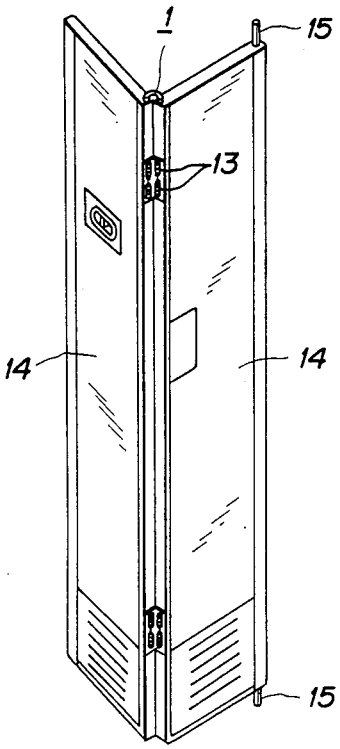
FIG. 4 is a perspective view of the hinge in use on a folding door.

The installing parts of joint 9 of the moving frames 3 are attached to the door panels 14, and as it is depicted in FIG. 4. The panels are joined in the middle through longitudinal flanges 7 and 8 which are screwed into the door panels 14 with hidden nuts.

Figure 5:
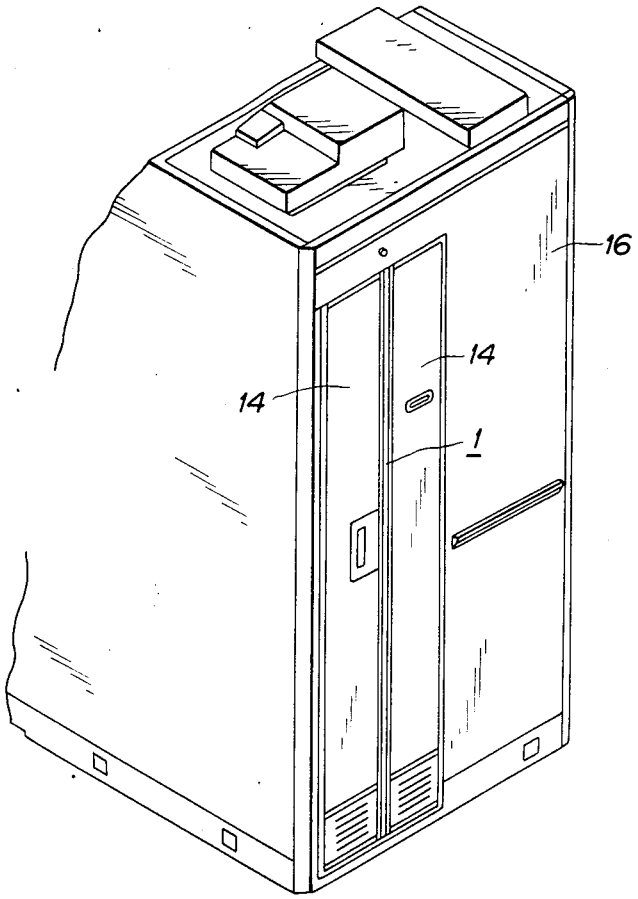
FIG. 5 is a perspective view of the hinge and folding door in use in an airplane lavatory.

An installation example of such a door is shown in FIG. 5 as it would be set for an aircraft lavatory, using two hinge pins at the top and bottom of a panel 14.

Therefore, as shown in FIG. 1, when the user pushes the closed door in the middle, the two panels 14 allow the hinge to turn inward resulting in the folding of the door completely, and the door opening. At this point, the two door panels 14 pivot around the supporting shafts 6 engaged with the cavities 12 of the moving frame, as the cogs 11 simultaneously rotate in order to obtain a smooth folding of the door panels. In the reverse, if the door 14 is closed, the pair of moving frames 3 shut as well, by means of the movement of their cogs 11. A hinge pin 15 is provided for the door to pivot on.

With this invention, a higher degree of hermetic sealing will be obtained. Moreover, the basic frame itself serves as a cloth cover without leaving any stains from rubbing, just as it avoids the noise of opening and closing which was a main shortcoming of the double hinge system.

I claim:

1. A hinge for use in a folding door, comprising:

A basic frame extending loingitudinally and having a generally C-shape in cross-section, said basic frame having support shafts extending longitudinally and disposed one on each edge of said basic frame to form a longitudinal opening therebetween;

a pair of moving frames each having opposed longitudinal flanges supporting the longitudinal edge of a door therebetween;

supporting pieces extending from the moving frame, through said longitudinal opening into the center of said basic frame, the tips of said supporting pieces from each of the moving frames contacting and co-acting with one another, the interior surface of each of said tips being formed in a generally semicircular shape to cooperatively engage one of said support shafts for rotation therearound; and a longitudinal edge extending from one of the longitudinal flanges of each moving frame such that said longitudinal edge is in constant contact with the outside surface of the basic frame as it slides along the outside surface of said basic frame, to form a light and odor seal.

2. The hinge of claim 1, wherein exterior surfaces of said tips are cogs meshing with one another.

3. The hinge of claim 1, wherein a spring is provided between said pair of moving frames, to bias said frames together.

* * * * *